United States Patent [19]

Breen

[11] Patent Number: 4,614,363

[45] Date of Patent: Sep. 30, 1986

[54] NEGATIVE-IMAGE GENERATING, TAMPER-RESISTING NEGOTIABLE INSTRUMENTS

[75] Inventor: Thomas J. Breen, Arlington Heights, Ill.

[73] Assignee: Rand McNally & Co., Skokie, Ill.

[21] Appl. No.: 509,947

[22] Filed: Jun. 30, 1983

Related U.S. Application Data

[63] Continuation-in-part of Ser. No. 425,064, Sep. 30, 1982, Pat. No. 4,512,592.

[51] Int. Cl.[4] ..... B41L 1/24; B41L 1/36

[52] U.S. Cl. ..... 282/22 R; 282/9 R; 282/28 R; 283/94; 428/204; 428/488.4

[58] Field of Search ..... 428/203, 204, 488.4, 428/488.1, 916; 282/9, 22 R, 28 R; 283/94

[56] References Cited

U.S. PATENT DOCUMENTS

| | | | |
|---|---|---|---|
| 3,032,355 | 5/1962 | Zalkind | 282/22 R |
| 4,045,053 | 8/1977 | Carriere | 282/22 R |
| 4,051,295 | 9/1977 | Bernstein | 428/206 X |
| 4,092,449 | 5/1978 | Bernstein | 428/916 X |
| 4,143,891 | 3/1979 | Neubauer | 428/488.4 X |
| 4,208,066 | 6/1980 | Steidinger | 282/21 R X |
| 4,403,793 | 9/1983 | McCormick et al. | 282/9 R X |
| 4,512,595 | 4/1985 | Breen | 282/28 R X |

FOREIGN PATENT DOCUMENTS 0434475 11/1933 United Kingdom ..... 283/94

*Primary Examiner*—Robert L. Spruill
*Assistant Examiner*—Taylor J. Ross
*Attorney, Agent, or Firm*—Dressler, Goldsmith, Shore, Sutker & Milnamow, Ltd.

[57] ABSTRACT

A tamper-resisting negotiable instrument, its method of manufacture and use are disclosed. The instrument includes a stack of webs comprising a first web having a lower surface adapted to receive images; a second, removable web, having an image transferring layer on its upper surface in contact with the image receiving surface of the first web and an image receiving layer on its lower surface; and a third removable web including an image transferring layer on its upper surface facing the second web. The image transferring layers comprise selected areas of the web upper surfaces which provide data zones in which specific information is desired to appear. Inscription of an image against the upper surface of the top web in the stack transfers the image from the image transferring layers of the webs therebelow to the lower surfaces of the webs thereabove leaving negative images in the data zones of the image transferring layers. Visual inspection of the negative images shows those images have been altered if there has been tampering.

10 Claims, 2 Drawing Figures

NEGATIVE-IMAGE GENERATING, TAMPER-RESISTING NEGOTIABLE INSTRUMENTS

DESCRIPTION

Cross-reference to Related Application

This is a continuation-in-part of application Ser. No. 425,064 filed Sept. 30, 1982, now U.S. Pat. No. 4,512,592, dated Apr. 23, 1985.

TECHNICAL FIELD

This invention relates to multipart negotiable instruments that are resistant to tampering, and particularly to multipart books of negotiable airline ticket blanks which contain a substantially transparent verifying web.

BACKGROUND ART

Tampering with multipart negotiable instruments, such as checks, drafts, and tickets, such as airline tickets, by altering the amounts or destinations, or other information causes great monetary losses to the enterprises issuing them. Although various proposals have been made to alleviate this problem, they have not been entirely successful.

Substantially all of the efforts in preparing tamper-resisting negotiable instruments have been directed either toward tamper-resisting inks and indicia printed with them or to the construction of the web that comprises the instrument itself, rather than to providing an additional web that can be used to verify the information upon the instrument. Various attempts to solve the post-issuance alteration problem in negotiable instruments and credit card-type applications can be found in U.S. Pat. Nos. 4,143,891, 4,051,295 and 4,092,449.

None of the above art teaches or suggests that a tamper-resisting negotiable instrument can be prepared that contains a separate, verifying web as is described herein.

In addition, tickets such as airline tickets are typically coated on their back sides with a colorant such as a dye or pigment dispersed in a hydrophobic medium such as an oil plasticized carnauba wax. That coating serves to transfer an image inscribed on the upper ticket blank to the ticket blank therebelow.

Such materials, while effective for transferring images, suffer from at least two drawbacks. First, the transferred image may readily be removed by light rubbing with an organic solvent or by placing an adhesive tape over the transferred image followed by removing the tape and adhered image. Second, those image transferring coatings have been found to cause respiratory and other problems among personnel who make the ticket blanks, and also provide a fine mist of colored material in the work environment.

SUMMARY OF THE INVENTION

According to the present invention, multipart negotiable instruments are prepared that have improved resistance to tampering after images are applied thereto. In one embodiment, the instrument is comprised of a stack of at least a first generally planar, substantially transparent web, a second generally planar web, and a third generally planar web.

The first, substantially transparent web is secured into the instrument and defines an upper surface and a lower surface. The lower surface of the first web is adapted for receiving an image transferred from a surface in contact with and confronting that image receiving surface and receives the image when a corresponding image is inscribed against the surface of the top web in the stack. The image receiving surface includes a waxy substance having a melting point range of about 165° F. to about 185° F.

The second web is removably secured within the instrument. The second web also defines an upper surface and a lower surface, with the upper surface being in contact with the surface of the first web that is adapted for receiving images. The upper surface of the second web that is in contact with and confronts the lower surface of the first web includes a data field zone that contains an image transferrring layer in register with at least a portion of the image receiving surface of the first web.

The image transferrring layer is capable of transferring an image to the image receiving surface when the corresponding image is inscribed against the surface of the top web in the stack. The image transferring layer comprises a particulate matrix erasably bonded to the second web that is defacable when rubbed with an organic solvent, and is removable when an adhesive tape is applied to the image transferring means and then pulled away.

The lower surface of the second web includes an image receiving layer in contact with and confronting an image transferring layer on the upper surface of the third web. The image receiving surface is substantially similar to the image receiving surface of the first web.

The third web is removably secured with the first and second webs and is beneath the first and second webs. The third web defines an upper and a lower surface, with the upper surface in contact with and confronting the lower surface of the second web.

The upper surface of the third web includes a data field zone capable of visualizing an image when a corresponding image is inscribed against the surface of the top web. That data field zone contains an image transferring layer substantially similar to that of the second web, and is in register with the image receiving surface of the first web and the image transferring layer of the second web.

When an image is inscribed against the surface of the top web, a corresponding image is transferred upwardly to the image receiving surfaces of the first and second webs and is formed as a negative image on the data field zones of the second and third webs. The positive image on the lower surface of the first web and the negative images on the upper surfaces of the second and third webs are substantially superimposed, and the superimposition of the images at least on the second web is observable when viewed through the first web.

In a particularly preferred embodiment of this invention, the negotiable instrument is a ticket, such as an airline ticket, and the first, second, and third webs correspond respectively to a verifying web, and two ticket blank webs. An auditor's coupon web may also be interposed between the visualizing and ticket blank webs in most preferred practice.

Methods of preparation of the negotiable instrument of this invention and its use are also disclosed.

The present invention has several benefits and advantages. One advantage is that tamper-resisting multipart negotiable instruments and tickets in particular, can be prepared relatively inexpensively.

Another advantage is that the image formed on a verifying web is superimposable upon the image on the instrument, e.g., ticket, itself so that a person accepting the instrument can quickly and easily determine if the instrument has been altered by looking through the verifying web to see if the images on both the verifying web and the instrument match substantially identically.

One of the benefits of a particularly preferred embodiment of the present invention is that the surface of the negotiable instrument bearing the transferred image faces the surface of the verifying web containing the same image, thereby making tampering with the image on the verifying web difficult because of the difficulty in properly aligning the image on a tampered instrument with that which must be upon the verifying web.

Still further benefits and advantages of this invention will be readily apparent to those skilled in the art from the description of the invention that follows and the embodiments thereof, from the claims and from the accompanying drawings.

BRIEF DESCRIPTION OF THE DRAWINGS

In the accompanying drawings forming a part of the specification, and in which like numerals are employed to designate like parts of the same.

Detailed Description

This invention can be practiced and used in many different forms. The specification and accompanying drawings disclose a specific example of the invention and the invention is not intended to be limited to the specific example illustrated.

For ease of description, the embodiments of this invention will be described in a normal position of use, and terms such as, upper, lower, above, beneath, top, bottom, contact, register and stacked relation and the like will be used with reference to the normal position of use. It will be understood, however, that the multipart negotiable instruments or tickets of this invention can be manufactured, stored, transported, sold and used in other orientations.

Figure 1:
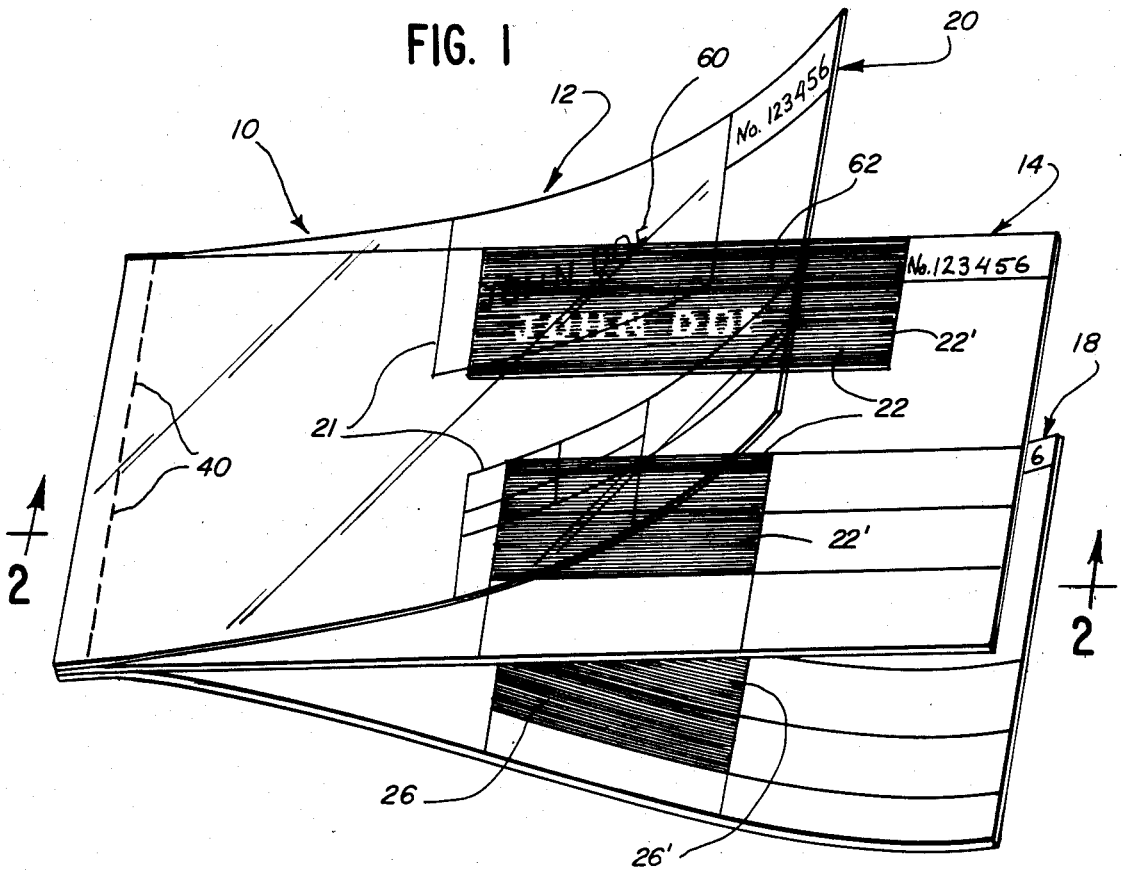
FIG. 1 is a perspective view of a partially inscribed presently preferred embodiment of a multipart ticket of this invention having the verifying web partially folded backward.

FIG. 1 illustrates a multipart negotiable instrument such as a book of airline tickets. Although the further description of the present invention will be made with regard to books of airline tickets, it is apparent that the principles and subject matter disclosed are equally applicable to other multipart negotiable instruments, such as train and bus tickets, and the like, wherein multiple copies are desired to be prepared from an original without the use of mechanical copying equipment, and particulary where tampering with one or more of the multiple copies is a problem to be anticipated. Other multipart negotiable instruments such as checks and drafts may be so made as well.

Referring now to the drawings, the book of blank tickets 10 according to this invention contains a stack of at least three sheets or webs, namely, a first web 12, which may be transparent, a second web 14 which may be a ticket blank, and a third web 18 which may be a ticket blank. The webs may comprise ordinary paper.

The first web 12 carries an image receiving layer 20 on its back or lower surface, the second web 14 carries an image transferring layer 22 on its front or upper surface and an image receiving layer 24 on its back or lower surface, and the third web 18 carries an image transferring layer 26 on its front or upper surface. The respective pairs of image receiving and transferring layers 20, 22 and 24, 26 are juxtaposed to confront and contact each other.

In preferred practice, the image transferring layers 22, 26 may be subdivided and may be disposed only in selected zones, usually comprising data fields 22' and 26' from which images may be transferred. The fields 22' and 26' are preferably defined by border lines or other indicia, as well as comprising data, such as lines or other selected information or data, usually defined by printing on the web surfaces and either under or over the image transferring areas.

The image transferring layers are formed such that when an image is scribed on or against the uppermost web, material underlying the scribed zones will transfer upwardly from the image transferring layer to visualize an image corresponding to the scribed image.

Figure 2:
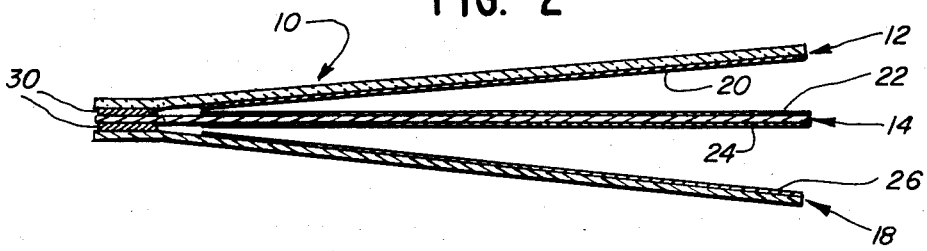
FIG. 2 is an enlarged cross-sectional view of the embodiment of FIG. 1 shown, for ease of illustration, in a partially open position taken along line 2—2.

When more than two ticket blank webs are present in the book of ticket blanks, or when an auditors coupon is used, and a transparent anti-forgery web is used as well, additional webs will be necessary. In that case, each pair of confronting web surfaces may employ the pairs of image transferring and receiving layers of this invention in the selected zones, and especially those which are to remain with the passenger when his ticket book is given to him. Also, when more than two ticket blanks are used, the bottom most ticket blank web will generally resemble the third web 18 shown in FIG. 2.

The first web 12, the second web 14, and the third web 18 are stacked and secured within the negotiable instrument. The stack is preferably made into book form by any convenient means such as by adhesive layers 30. Additional ticket blank webs (not shown) may be included in the negotiable instrument, and are secured therein by similar means. Each of the webs (except the transparent web 12) are removable from the book along lines of perforation, such as score lines 40. Additional webs may also be removable from the instrument. It is particularly preferred that where web 12 is a transparent verifying web, that it not be readily removable from the instrument so that it will remain with the issued ticket and can be used for its verifying, anti-forgery purposes.

The verifying web 12 is substantially transparent, and its lower or back surface is adapted to receive images tranferred from the image transferring layer 22 on the upper surface of the web 14 in contact with and confronting the image receiving surface when a corresponding image is inscribed against the surface of the top web in the stack.

As used herein, the phrase "substantially transparent" is meant to include both transparency and translucency. A substantially transparent verifying web of this invention will permit sight of images upon the underlying ticket blank through the overlying verifying web.

The verifying web 12 may be prepared from a variety of substantially transparent materials. Included among these materials are substantially clear plastics such as polyethlene, polypropylene, and polyethlene terephthalate. Paper-derived webs are particularly preferred and include glassine and tracing papers as well as tissue paper and the like. Tissue paper having a weight of about 20 to about 30 pounds per ream of 24 inch by 36 inch paper is particularly preferred for use as the verifying web.

An image receiving layer 20 is provided on the back of the web 12 to promote transfer of the image to, and retention of the transferred image on, the image receiving surface. The image receiving layer 20 of the verifying web 12 is preferably composed of a waxy substance.

A particularly preferred waxy substance is a mixture of relatively soft, low melting point microcrystalline waxes, paraffin waxes and oxidized homopolyethylene. The useful microcrystalline waxes have typical melting point ranges of about 160° F. to about 185° F. and have needle penetration values of about 20 to about 85. The paraffin waxes typically have a melting point range of about 135° F. to about 155° F., while the oxidized homopolyethylene melts in the range of about 215° F. to about 255° F.

The microcrystalline waxes are typically present at about 45 to about 75 weight percent of the waxy substance, with the paraffin wax typically being present at about 20 to about 40 weight percent and the oxidized homopolyethylene being present at about 2 to about 8 weight percent. Additional materials such as plasticizers and fillers may also be present.

A particularly preferred waxy substance comprising the image receiving layer 20 typically has a congealing point in the range of about 155° F. to about 175° F., with a melting point range of about 165° F. to about 185° F. A useful, particularly preferred waxy substance is available from Frye Copysystems, Inc. of Des Moines, Iowa and is sold under the trademark IMPACT CF coating.

The particularly preferred waxy substance is coated onto the verifying web at a temperature of about 200° F. to about 235° F. using standard coating methods. Use of a coating temperature at least about 15° F. above the melting temperature of the waxy substance permits penetration of the waxy layer into the verifying web.

The waxy coating is preferably applied in an amount to provide a layer 20 weighing about 0.7 to about 1.3 pounds per ream of 20 inch by 30 inch paper, where the entire surface of the paper is coated.

Coating weights below the preferred amounts usually result in broken images upon transfer from the image transferring layers 22, 26. Coating weights above the preferred amount can be used, but provide a substantially continuous waxy film on the verifying web which tends to prohibit penetration and drying of subsequently applied printing inks.

Coating of the image receiving layer 20 in the above, preferred range, provides a layer 20 which is slightly discontinuous and permits penetration of subsequently applied printing inks into the verifying web stock for drying purposes. Viewing of a verifying web so prepared in the light shows hills and valleys of the coating that comprises the image receiving layer 20.

The first web, when not used as a verifying web, and the remaining webs of the ticket books can be made from various papers and synthetic fibers as known in the art for the preparation of tickets and other multipart negotiable instruments. In preferred practice, the webs are paper, and the surfaces of the paper are hardened and smoothed as desired with conventional sizings and or by calendering. The hardening assists in retarding penetration of the various layers that are subsequently applied to the surfaces of the webs.

The smoothness of the preferred paper webs can differ from one surface of the web to the other, and can be specified in units of microinches by a surface smoothness indicator in accordance with the standard paper industry smoothness measurements. In preferred practice, both surfaces may have a smoothness of about 35 microinches to about 100 microinches. In more preferred practice the paper web surface of the web 14 that includes the image tranferring layer 22 may have a surface smoothness of about 50 microinches to about 85 microinches. Surface smoothness can be measured using a Gould SURFANALYZER 7100 model 21-01200-00 manufactured by Gould, Inc. of Rolling Meadows, Ill.

The image transferrring layers herein such as layer 22 of the web 14 comprises a particulate matrix. The particulate matrix can itself be comprised of a number of solid materials that are insoluble or substantially insoluble in water and organic solvents. Exemplary particulate materials include usual inorganic pigments and fillers such as titanium dioxide, zinc oxide, silica, calcium carbonate, calcium sulfate, and the like and mixtures thereof. The choice of fillers can be made to vary the opacity of the ultimately formed, transferred image.

The particles are ground to a fine consistancy so that they can be preferably printed flexographically upon the upper surface of the web. A useful average particle size is about 15 to about 16 microns for the largest dimension. Preferably, the average particle size is about 5 to about 6 using North Standard Measurements of of particle size which correspond to particles having an average largest dimension of about 25 to about 40 microns.

The particulate matrix is erasably bonded to web 14 by an organic polymer that can be soluble or dispersible in organic solvent or in water or mixtures thereof. Exemplary organic polymers include polyvinyl butyral resin, acrylic ester homopolymers and copolymers, such as those of acrylic acid and methacrylic acid esters of $C_1$–$C_8$ alcohols polymerized with themselves as well as with other monomers such as styrene, acrylic acid, methacyrlic acid, maleic acid, acrylamide, methacrylamide and N-substituted $C_1$–$C_8$ derivatives thereof.

As is known in the latex paint art, polymers that contain acidic groups can be made water soluble or dispersible by at least partial neutralization of the acid groups with an inorganic base such as sodium hydroxide, amines such as ammonia or ethanolamine and the like. In addition, water solubility and dispersibllity can also be improved by copolymerization of monomers that contain hydroxyl groups such as 2-hydroxylethyl acrylate or N-(2-hydroxylethyl) methacrylamide Polyvinyl butyral resins are particularly preferred.

The image transferring layers 22, 26 can be applied to the webs by lithographic, gravure, flexographic, or similar printing techniques.

In preferred practice, the weight ratio of organic solvent-soluble polymer to that of the particulate matrix in the preferred flexographic-type ink is about 1:3 to about 1:5.

It is preferred that the polymer be dissolved or dispersed in an organic solvent, and the phrase "organic solvent" will be used illustratively hereinafter with the understanding that water, admixtures of water with an organic solvent are also useful. The words "soluble" and "dissolved" will be used for convenience hereafter to include materials that are soluble or dispersible, and dissolved or dispersed, respectively.

As noted above, the image transferring layers are preferably flexographically printed onto the webs. To that end, the particulate matrix and bonding polymer are dissolved in a suitable solvent to form a flexographic-type ink.

The phrase "organic solvent" is used herein to include usual liquid solvents of low molecular weight (less than about 250 Daltons). Typically useful organic solvents for the flexographic ink include hydrocarbon solvents such as hexane and benzene, ketones such as acetone and methyl ethyl ketone, and esters such as ethyl acetate and butyl acetate, chlorocarbons such as trichloroethylene, trichloroethane and chloroform, as well as alcohols such as methanol, ethanol, and the like. In addition, mixed organic solvents, such as lacquer thinner and mineral spirits as well as mixtures of the above solvents fall within the definition "organic solvent" as used herein. A particularly preferred organic solvent is ethanol.

The organic solvent is preferably used in a volume, which if anhydrous ethanol, would comprise about 40 to about 60 weight percent of the total flexographic-type ink used for making the image tranferring layers 22, 26. More preferably, the volume of organic solvent comprises about 45 to about 55 weight percent of the flexographic-type ink, as asbolute ethanol.

The amounts of the above ingredients comprising the preferred flexographic-type ink used to prepare the image tranferrring layers 22, 26 are easily adjusted to provide a coating, after drying at a 150° F., of about 1.25 to about 1.55 pounds per ream of coated paper; the paper measuring 20 inches by 30 inches. In more preferred practice, the amount of image transferring means after drying is about 1.3 to about 1.45 pounds per ream calculated upon the area the web covered with the transferring means. That desired amount is typically obtainable from a composition that has a viscosity using Zahn No. 2 conditions at 70° F. (21° C.) of about 50 to about 65 seconds.

A flexographic ink suitable for use in preparing the image transferring layers 22, 26 is available from Frye Copysystems, Inc. under the trademark IMPACT CB coating. It is noted that the combination of an opaque paper web coated on one side with a layer of the IMPACT CB coating and a second opaque paper web coated with the before-mentioned IMPACT CF coating has been used for transferring images in so-called "carbonless" copying. However, that use does not include transfer of an image to a substantially transparent web for the purpose of verifying the correctness of transferred images on webs therebelow by superimposition of the webs and their transferred images. Neither does the prior use contemplate the production of negative images in positive data fields in multipart negotiable ticket forms.

It is also noted that the image transferring layers 22, 26 do not cover the entire surface of their webs. In preferred practice, the image transferring layers such as layer 22, covers only a portion of the first or upper surfaces of the webs 14, 18, e.g., for tickets, that portion containing points of origin and destination as well as the area wherein the cost of the trip is inscribed to provide data field zones 22' and 26'.

The image transferring layer, e.g., 22, may be further characterized in that after its application and drying, it may be defaced and also stained by light fingertip rubbing with organic solvents such as those useful for preparing the flexographic ink. The image transferring means also demonstrates defacement when liquid water is lightly rubbed upon its surface, although the layers are preferably somewhat sensitive to water than to organic solvents to permit ease of usage under conditions of high relative humidity. The image transferring means is also removable from the auditor's coupon when rubbed with a pencil eraser.

The image transferring layers 22, 26 are also removable from the web surface when an adhesive tape having a bond strength to steel of about 5 ounces per linear inch (about 5.5 Newtons per 100 millimeters) is applied and then pulled away therefrom under conditions of Federal Test Methods Standard 147c. Substantial removal of the image transferring layer can be effected by an adhesive tape having a bond strength steel of about 6 ounces per foot (about 7 Newtons per 100 millimeters) and subsequent pulling of the tape away from the surface of the image transferring layer, using the above test conditions.

When less than the above amounts of image transferring layer material is applied to the web surface, transfer of an image to the image receiving surface of an upper, overlying web can be impaired. When greater than the above amounts of image transferring material is applied as that layer, the image transferring layer tends to crack or flake off prematurely, and much of the flexibility of the image transferring layer is lost.

As noted previously, the surface of the web 14 including the image transferring layer 22 may define data fields or areas 22' from which the images are transferred. Those areas are defined by information indicia, or data applied at least in part over or under the image transferring layers, as by conventional printing techniques such as offset and lithographic printing, using standard printing means.

Tamper-resisting indicia or other data such as colors, a pattern of lines (as shown in zones 22') or spots can also be printed over the image transferring layers, and can be transferred with the image to the verifying web, to further reduce the chances of tampering with an issued ticket. Thus, the transferred image will contain a portion of the tamper-resisting indicia originally present on image transferring layer of the web 14. The image transferring means can also include colored and/or luminescent dyes or pigments to further reduce the chances of successful tampering with an issued ticket.

The confronting pair of image receiving layer 20 and image transferring layer 22 is provided to transfer upwardly from zones 22' to the back of web 12, thereby to provide negative images in the data fields 22'. The confronting surfaces of webs 14, 18 bearing the pair of image receiving and transferring layers 24, 26 are formed to cooperate in the same manner. The layers 24, 26 may be disposed, provided and formulated in the same way to provide data fields 26' in which negative images are produced at the same time negative images are produced in data field 22'.

The word "inscribed" in its various grammatical forms as used herein mean a sufficient amount of pressure is applied directly or indirectly to the surface of a top web in a stack, such that an image corresponding to the inscribed image can be transferred from the image transferring layers on second and third webs (or more if additional webs are used) to the image receiving layers on the confronting webs. Normal pressures used in writing with a ballpoint pen, pencil or typewriter are sufficient for that inscribing.

In another embodiment of this invention (not illustrated), the relative positions of the second web, which may be an auditor's coupon web, and a first, verifying web 12 are reversed relative to the ticket blank webs in the stack; i.e., the auditor's coupon web is above the verifying web in the stack of webs comprising the book.

In this embodiment, the auditor's coupon web will have the image receiving layer on its back surface and the verifying web will have a transferring layer on its front and a receiving layer on its back.

To prepare a preferred ticket blank book 10 of the instant invention, a first substantially transparent, generally planar web 12 is provided with an image receiving layer, adapted for receiving a transferred image on the lower surface. In particularly preferred practice, a coating comprising image receiving layer 20 is pre-applied to at least a selected portion of the lower surface of that first web 12 in an amount sufficient to receive an image transferred from a surface in contact with the image receiving layer when a corresponding image is inscribed against a surface of the top web in the stack.

A second generally planar web 14 defining a first upper surface and a second layer surface is also provided. A coating of image transferring material is applied to at least a portion of the upper surface of that second web, as by flexographic printing, to form an image transferring layer 22. That image transferring layer comprises the above-described particulate matrix that is erasably bonded to that web surface.

A third web 18 defining a first upper surface is provided with an image transferring layer 26 capable of visualizing an image when a corresponding image is inscribed against a surface of the top web.

The first, second and third webs are placed in stacked relation so that the one surface adapted to receive images of the first web and the one surface of the second web bearing the image transferring layer are in contact. The third web is positioned below the first and second webs in the stack. The data field zones of the second and third webs are positioned to face upwardly and are in register with the image receiving layer 24 of the second web 14, thereby providing for visualization of images transferred to and received by the surface of the first web.

The second and third webs are preferably made removable from the book of ticket blanks by providing score lines 40 in the webs at the desired locations prior to incorporation of those webs into the book of ticket blanks.

Webs of this invention that include both image receiving and image transferring layers are preferably first coated with the image transferring layer, and that layer is dried to the touch. Printing of indicia over the surface of the image transferring layer and thereby covering at least a portion of that layer follows thereafter, followed by coating the image receiving layer on the lower surface thereof. Each lower web is preferably prepared in that sequence.

The ticket blank books provide improved resistance to tampering after the ticket or instrument is issued. An image is inscribed against the surface of the top web, transferring the inscribed image from the image transferring layer 22 on the upper surface of the second web upwardly to the lower surface of the verifying or other web 12'. That image so transferred is a positive image 60, leaving a negative image 62 (FIG. 1) in the image transferring layer data field. The same act of inscription transfers the corresponding image in the same way with each lower pair of confronting layers 24, 26, and any others on fourth, fifth, or other webs.

It is noted that in discussing transfer and receipt of images, reference has been made to inscription against the surface of the top web in the stack. That reference is made for convenience, for the inscription may be made against the surface of the bottom web in the stack with the same result. Inscription against the surface of the top web is also meant to include situations in which one or more sheets are above the verifying web 12 in the stack.

It is further noted that the phrase "inscribed against" in its various grammatical forms has been used herein rather than the phrase "inscribed upon". Thus, while an image may be inscribed upon the surface of the top web, e.g. the verifying web, an image need not appear upon that surface, and preferably does not so appear when the top web is the verifying web. Rather, the image on the web 12 is a transferred, positive image 60 which appears upon the image receiving surface of that web.

After the ticket has been issued, one may check it for tampering, as by observing the superimposition of the images, if the top web, is a transparent verifying web, and the underlying zones of the webs 14, 18. If the ticket is unaltered, the images on both webs are substantially identical and substantially superimposable. If the ticket has been tampered with, the person checking the tickets should be able to make that determination by the lack of superimposition of the various images that are upon the two webs by looking through the verifying web. Of course if the verifying web is not transparent, alteration will be apparent by the fact that the image transferring area will have been permanently disfigured if any of the usual alteration techniques are used.

The invention is further illustrated by the examples which follow.

BEST MODE FOR CARRYING OUT THE INVENTION

Example 1: Book of Airline Ticket Blanks

A book of negotiable airline ticket blanks according to this invention was prepared as follows.

A verifying web 12 is prepared from a roll of tissue paper having a weight of 25 pounds per ream when cut into pieces 24 by 36 inches square. This paper is available from Rinelander Paper Company, of Rinelander, Wis. under the trademark RINLANDER X-2501 translucent paper. The specifications for this paper include a tear force of 12 grams in the machine direction and 14 grams across the machine direction; an opacity of 29 percent and a transparency of 65. Opacity percentages were measured using a Diano-BN 1-2 Opacimeter manufactured by Diano Corporation of Woburn, Mass. Transparency was measured using a Martin Sweets Transparency Tester, manufactured by the Martin Sweets Company, Inc., of Louisville, Ky., and designed by the Glassine and Greaseproof Manufacturers Association. The paper averages a thickness of 1.8 mils.

The tissue paper was coated on one surface with a waxy substance that is a mixture of microcrystalline waxes, paraffin waxes and oxidized homopolyethylene sold under the trademark IMPACT CF coating by Frye Copysystems, Inc. of Des Moines, Iowa. This material was discussed in greater detail hereinbefore.

The tissue paper was roller coated with the waxy substance, with the waxy substance at a temperature of about 200° F. to about 235° F., to provide a layer adapted to receive images on the second surface of the tissue paper. The layer so applied weighed about 0.7 to about 1.3 pounds per ream of 20 by 30 inch tissue paper.

After the waxy substance layer had solidified, the first surface of the coated tissue paper was printed with lines to define zones 21 for receiving transferred images.

The coated and printed tissue paper was then cut to size for use as a verifying web.

Webs 14, 18, such as auditors webs and ticket webs useful in a book of ticket blanks of this invention were prepared from a white roll of calendered paper having a smoothness of about 80 microinches on one surface and a smoothness of about 60 microinches on the other surface. The image transferring layer was applied on a selected area on the 80 microinch surface by flexographically printing a dispersion of North Standard size 5–6 particles and polyvinyl butyral resin in organic solvent. The weight ratio of particles to copolymer to solvent was about 21:5:24, with the solvent comprising a mixture of ethanol and ethyl acetate in a weight ratio of about 13:1, respectively. The dispersion had a Zahn No. 2 viscosity of 57 seconds at 21° C. (about 70° F.). Total solids content of the dispersion was about 54 percent by weight and included small amounts of plasticizing oils. The image transferring layer was applied at an average generally uniform coverage of 1.3–1.45 pounds per ream, afer drying at 150° F. The flexographically applied image transferring coating used was the previously described IMPACT CB coating available from Frye Copysystems, Inc.

The surface bearing the image transferring layer was then further overprinted with lines to define data fields and zones, and with other airline ticket indicia. That printing was then dried.

The lower surface of web 14 was then coated is the same manner in which the lower surface of web 12 was coated, and web 18 was then prepared in the same manner as web 14, except that as the bottom most web in the stack, the image receiving layer was omitted.

The above prepared webs were then assembled into a stack having the web 12 on top, and ticket blank web 14 immediately below it, with the waxy substance image receiving layer of the verifying web in contact with the surface of web 14 bearing the image transferring layer. The ticket blank web 18 bearing an image transferring layer was placed below the web 14 with the surface bearing the image transferring layer in contact with the image receiving layer of the above web 14.

A plurality of webs similar in construction to webs 14 may be prepared when an auditor's coupon or more than two ticket blank webs are desired. Such additional webs are placed into the stack between the topmost, verifying web 12 and the bottommost ticket blank web 18.

The data fields for receiving transferred images and transferring layers were aligned and registered. Adhesive was then placed between the webs in the areas defined by the perforations and adjacent edges of the lower webs, and the webs were thereby glued together to form a book of negotiable ticket blanks of this invention.

An image was then inscribed against the surface of the verifying web opposite the image receiving layer and within the data field 22' for receiving transferred images. That inscription transferred images from the transferring layers to the image receiving layers.

Viewing of the ticket book through the verifying web showed that the images on the verifying web and the ticket web therebelow were superimposed. The ticket web below the verifying web was removed, along the lines of perforation of that ticket web, to thereby place the second ticket immediately below the verifying web. Viewing of the second ticket web through the verifying web again showed that the images transferred to and from each web were superimposed.

Example 2: Transfer Means Properties

Sample webs were prepared substantially similar to the web 14 of Example 1, with a green dye being printed over the image transferring material, and thereby to the image transferring layer. The green dye emits a yellow color under ultraviolet light. The sample webs were conditioned at 73° F. and 50 percent relative humidity for 48 hours in a convection oven prior to making the examinations. The results were as follows:

| | Observations |
|---|---|
| Application Of The Indicated Material Followed By Light Rubbing With The Index Finger | |
| Ethanol, Lacquer Thinner Acetone, Toluene, Trichloroethane | The green printing smeared and defaced when wet; permanent stain on drying was observed. |
| Mineral Spirits | The green printing rubbed off when the layer was wet; permanent stain on drying was observed. |
| Iso-propanol | The green printing smeared and defaced when the layer was wet; permanent stain on drying was observed. |
| Water, Soapy Water, Vinegar | Severe rub-off of printing; permanent stain on drying was observed. |
| Erasure By A Common Pencil Lead Eraser | Severe rub-off of green printing to the underlying white sized paper was observed, which was observable under ultraviolet light as a dull violet color contrasting with the brilliant yellow exhibited by the green zone. |
| Application Of SCOTCH Brand Adhesive Tape Over The Green Layer | When the tape was pulled off slowly, it removed the green layer and revealed the underlying white sized paper which was observable under ultraviolet light as a dull violet color contrasting with the brilliant yellow exhibited by the green zone. |

The foregoing results show (1) the solvents and chemical commonly used to alter airline tickets severely defaced the ticket surface by permanent staining or smearing of the image transferring layers; (2) the stains and defaced areas were very visible as dull violet discolorations under ultra-violet light and frequently as white areas by the naked eye, and (3) those physical properties provide readily discernible evidence to indicate that there was an attempt to alter the subject matter in the image transferring layers of the tickets.

Webs that would be useful for defining negative images in image transferring areas provided on negotiable instruments were examined for their resistance to successful tampering by means of erasure. The examination showed that even slight pressure successfully removed the image transferring layers.

From the foregoing, it will be observed that numerous variations and modifications can be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. A multipart negotiable instrument having improved resistance to tampering after inscription of an image thereon, said instrument comprising in stacked relation at least a first, substantially transparent generally planar web, a second generally planar web and a third generally planar web, each having an upper surface and a lower surface;

said first web being secured within said intrument and having an image receiving layer on it lower surface, said second web being removalby secured within said instrument and having an image transferring layer on its upper surface and an image receiving layer on its lower surface, said third web being removably secured within said instrument and having an image transferring layer on its upper surface, the image receiving layer on said first web contacting and confronting the image transferring layer on said second web, the image receiving layer on said second web contacting and confronting said image transferring layers also said third web, each said image transferring layer comprising a particulate matrix erasably bonded to said upper surface of the web and defacable when rubbed with an organic solevent, said image transferring layers also being removable when an adhesive tape is applied to said image transferring layers and then pull away; and said image receiving layers comprising a waxy substance having a melting point range of about 165° F. to about 185° F.;

the image transferring layers each comprising an image visulaizing area that is capable of visualizing images when a corresponding image is inscribed against the surface of said first web, said image visualizing areas being in register respectively with the image receiving layers of said lower surfaces of said first and second webs.

2. A multipart negotiable instrument in accordance with claim 1 wherein said image visualizing areas are each data fields disposed in selected zones of the respective upper surfaces, and wherein said instrument comprises a book of ticket blanks comprising said webs.

3. A book of negotiable instrument ticket blanks comprising at least one, generally planar, substantially transparent verifying web for receiving images inscribed on a ticket blank, at least one generally planar auditor's coupon web for transferring images inscribed on a ticket blank to said verifying web, and first and second ticket blank webs, said webs secured in said book in stacked, registered relation;

said verifying web defining an upper and a lower surface, said lower surface including a substantially transparent image receiving layer of a waxy substance having a melting point range of about 165° F. to about 185° F. for receiving an image transferred from a surface in contact with the image receiving layer when a corresponding image is inscribed against the upper suface of said verifying web in said book;

said auditor's coupon web defining an upper and a lower surface, and being removable from said book, said upper surface being in contact with and confronting the lower surface of said verifying web, said upper surface including an image transferring layer in register with said image receiving layer of said verifying web and capable of transferring an image to said receiving layer when a corresponding image is inscribed against the upper surface of said verifying web, said image transferring layer comprising a particulate matrix erasably bonded to the second web and defacable when rubbed with an organic solvent, said layer being removable when an adhesive tape is applied to said image transferring layer and then pulled away;

said auditor's coupon web lower surface including an image receiving layer comprising a waxy substance having a melting point range of about 165° F. to about 185° F.;

said first ticket blank web being disposed beneath said verifying and auditor's coupon webs and defining upper and lower surfaces, said upper surface being in contact with and confronting the lower surface of said auditor's coupon and including an image transferring layer capable of transferring an image to the lower surface of the the coupon web when a corresponding image is inscribed against the upper surface of said verifying web, said image transferring layer being in resgister with the image receiving layer of the verifying web and the image transferring layer of the auditor's coupon, said first ticket web lower surface including an image receiving layer comprising a waxy substance having a melting point range of about 165° F. to about 185° F.;

said second ticket blank web being disposed beneath said first ticket blank web and defining upper and lower surfaces, said upper surface being in contact with and confronting the lower surface of said first ticket blank web and including an image transferring layer capable of transferring an image to the lower surface of the first ticket web when a corresponding image is inscribed against the upper surface of said verifying web, said image transferring layer being in register with the image receiving layer of the verifying web, and the image transferring layers of the auditor's coupon and first ticket blank web.

4. A book of negotiable instrument ticket blanks in accordance with claim 3 wherein said adhesive tape has a bond strength of seel of at least about 5 ounces per linear inch.

5. A book of negotiable instrument ticket blanks in accordance with claim 5 wherein said waxy substance includes a mixture of relatively soft, low melting point microcrystalline waxes, paraffin waxes and oxidized homopolyethylene.

6. A method of preparing a multipart negotiable instrument having improved resistance to tampering once the instrument has been issued comprising the steps of:

(a) providing a first, substantially transparent generally planar web defining an upper surface and a lower surface, said lower surface being adapted for receiving a transferred image and having thereon a coating of a waxy substance having a melting point range of about 165° F. to about 185° F.;

(b) providing a second, generally planar web defining an upper surface and a lower surface;

(c) coating a portion of the upper surface of the second web to form an image transferring layer zone, said image transferring layer zone comprising a particulate matrix erasably bonded to said surface, defacable when rubbed with an organic solvent and removable when an adhesive tape is applied to said matrix and then pulled away;

(d) coating the lower surface of the second web with a waxy substance having a melting point range of about 165° F. to about 185° F.;

(e) providing a third generally planar web defining an upper surface and a lower surface, said upper surface including an area capable of visualizing an image; and (f) securing together said first, second and third webs in stacked relation with the upper surface of the second web that includes said image transferring layer zone contacting the lower surface of the first web that is adapted for receiving a transferred image, and with the third web beneath said first and second webs, said area of the upper surface of the third web capable of visualizing an image facing upwardly, said second and third webs being removably secured in said stack.

7. A method in accordance with claim 6 comprising the further steps of:

(g) coating a portion of the upper surface of the third web prior to securing together said first, second, and third webs to form an image transferring layer zone, said image transferring layer zone comprising a particulate matrix erasably bonded to said surface, defacable when rubbed with an organic solvent and removable when an adhesive tape is applied to said means and then pulled away, thereby to provide said third web upper surface capable of visualizing an image.

8. A method of preparing a multipart negotiable instrument having improved resistance to tampering once the instrument has been issed comprising the steps of:

(a) providing a first, substantially transparent, generally planar web defining a upper surface and a lower surface, said lower surface having thereon a coating of waxy substance having a melting point range of about 165° F. to about 185° F. and being adapted for receiving a transferred image;

(b) providing a second, generally planar web defining an upper surface and a lower surface;

(c) coating at least a portion of the upper surface of the second web to form an image transferring layer, said image transferring layer comprising a particulate matrix erasably bonded to said surface, defacable when rubbed with an organic solvent and removable when an adhesive tape is applied to said means and then pulled away;

(d) coating the lower surface of the second web with a waxy substance having a melting point range of about 165° F. to about 185° F.;

(e) providing a third generally planar web defining an upper surface and a lower surface, said upper surface including an area capable of visualizing an image; and (f) coating at least a portion of said area of the third web upper surface as was the second web upper surface to provide said area capable of visulizing an image; and (g) securing together in the order recited said first, second, and third webs in stacked relation with the upper surface of the second web contacting the lower surface of the first web and the lower surface of the second web in contact with the upper surface of the third web so that at least a portion of the image transferring layers on the upper surfaces of the second and third webs are in register with areas of the lower surfaces of the first and second webs, so that when an image is inscribed, the image will be visualized as negative images in the image transferring layers of the second and third webs.

9. A method of preparing a multipart negotiable instrument in accordance with claim 8 wherein said first web is made from a material selected from the group consisting of substantially clear plastic, glassine paper, tracing paper and tissue paper.

10. A method of using a book of negotiable ticket blanks to provide improved resistance to tampering after said book is issued comprising the steps of:

(a) providing the book of negotiable ticket blanks of claim 2;

(b) inscribing an image against the upper surface of the first web of said book and thereby forming substantially superimposed negative images on (i) the upper surface of said second web, (ii) the upper surface of said third web; and further forming a superimposed positive image on the lower surface of said first web;

(c) issuing the ticket book so inscribed; and (d) viewing the negative images on the upper surface of the second or third web which immediately below the verifying web through the positive image on the verifying web visually to detect whether the negative images have been tampered with.

* * * * *